US012722823B2

(12) United States Patent
Kim

(10) Patent No.: US 12,722,823 B2
(45) Date of Patent: Sep. 1, 2026

(54) TRANSPORT DEVICE FOR ELECTRODE DOUBLE PACKAGING DEVICE, AND ELECTRODE DOUBLE PACKAGING DEVICE COMPRISING SAME

(71) Applicant: LG ENERGY SOLUTION, LTD., Seoul (KR)

(72) Inventor: Dong Wook Kim, Daejeon (KR)

(73) Assignee: LG Energy Solution, Ltd., Seoul (KR)

( * ) Notice: Subject to any disclaimer, the term of this patent is extended or adjusted under 35 U.S.C. 154(b) by 301 days.

(21) Appl. No.: 18/579,281

(22) PCT Filed: Oct. 13, 2022

(86) PCT No.: PCT/KR2022/015514

§ 371 (c)(1),
(2) Date: Jan. 12, 2024

(87) PCT Pub. No.: WO2023/063749

PCT Pub. Date: Apr. 20, 2023

(65) Prior Publication Data

US 2024/0343434 A1 Oct. 17, 2024

(30) Foreign Application Priority Data

Oct. 14, 2021 (KR) ..... 10-2021-0136368
Oct. 20, 2021 (KR) ..... 10-2021-0140177

(51) Int. Cl.

| | |
|---|---|
| ***B65B 35/16*** | (2006.01) |
| ***B65B 25/14*** | (2006.01) |
| ***B65B 57/18*** | (2006.01) |

(52) U.S. Cl.
CPC ..... *B65B 35/16* (2013.01); *B65B 25/146* (2013.01); *B65B 57/18* (2013.01); *B65B 2220/20* (2013.01)

(58) Field of Classification Search
None
See application file for complete search history.

(56) References Cited

U.S. PATENT DOCUMENTS 5,836,538 A * 11/1998 Lencoski ..... B65H 16/06 242/399.1
2005/0058889 A1 3/2005 Goishihara
2008/0236102 A1 10/2008 Murakami et al.
(Continued)

FOREIGN PATENT DOCUMENTS

CN 109516194 A * 3/2019 ..... B65G 47/82
JP 1999-139486 A 5/1999
(Continued)

*Primary Examiner* — Tanzim Imam
(74) *Attorney, Agent, or Firm* — Bryan Cave Leighton Paisner LLP

(57) ABSTRACT

The present application provides a transport device for an electrode double packaging device, in which before the electrode roll primarily packaged with the first packaging bag is moved to the secondary packaging location, the first packaging bag is arranged such that it is closely attached to the electrode roll, whereby the jamming of the first packaging bag that can occur in the process of being transported to the second packing location is prevented, so that it is possible to solve the problem that the packaging bag is torn or the peripheral devices are broken, and an electrode double packaging device comprising the same.

15 Claims, 5 Drawing Sheets

(56) References Cited

U.S. PATENT DOCUMENTS

| | | | | |
|---|---|---|---|---|
| 2011/0218089 | A1* | 9/2011 | Demers | B31D 5/0047 493/338 |
| 2017/0021952 | A1* | 1/2017 | Smith | B65B 11/04 |

FOREIGN PATENT DOCUMENTS

| | | | | |
|---|---|---|---|---|
| JP | 2001-106435 | A | | 4/2001 |
| JP | 2002337816 | A | | 11/2002 |
| JP | 2002347713 | A | | 12/2002 |
| JP | 2003-026113 | A | | 1/2003 |
| JP | 2005096810 | A | | 4/2005 |
| JP | 2005-255225 | A | | 9/2005 |
| JP | 2006-124021 | A | | 5/2006 |
| JP | 2007-326640 | A | | 12/2007 |
| JP | 2009-522177 | A | | 6/2009 |
| JP | 2014158016 | A | * | 8/2014 |
| KR | 20-2000-0018832 | U | | 10/2000 |
| KR | 10-2017-0044825 | A | | 4/2017 |
| KR | 10-2017-0112392 | A | | 10/2017 |
| KR | 10-2020-0066018 | A | | 6/2020 |
| WO | 2012060142 | A | | 5/2012 |

* cited by examiner

[Figure 1]
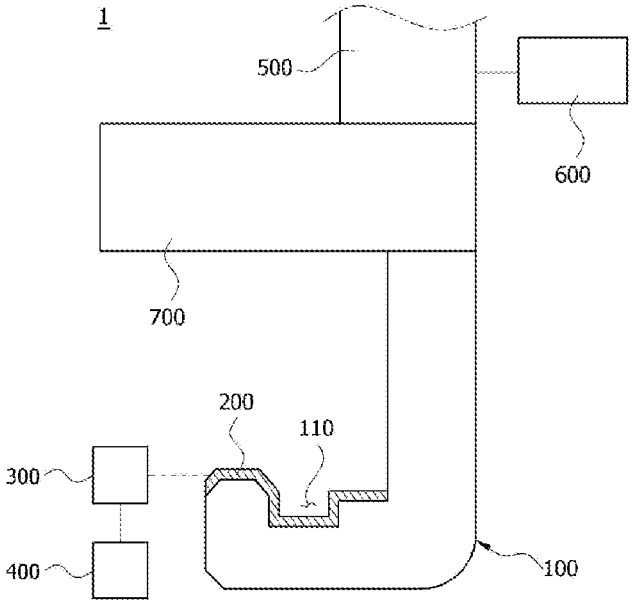
[Figure 2]
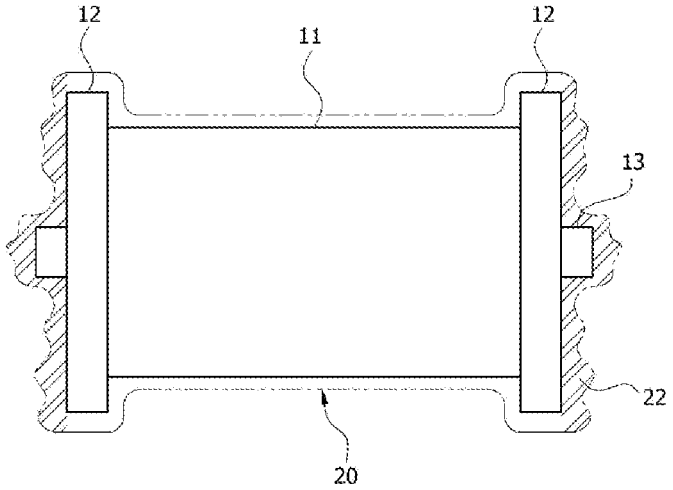

[Figure 3]
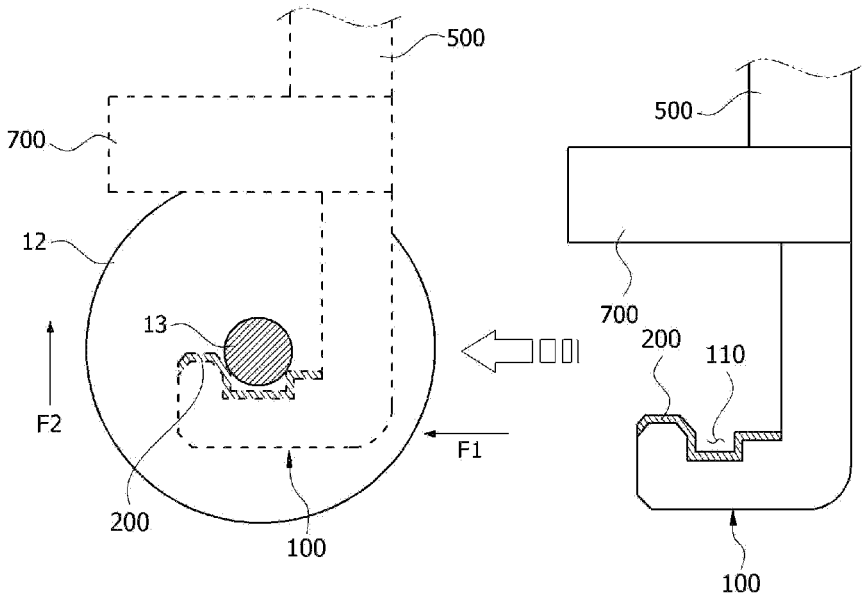
[Figure 4]
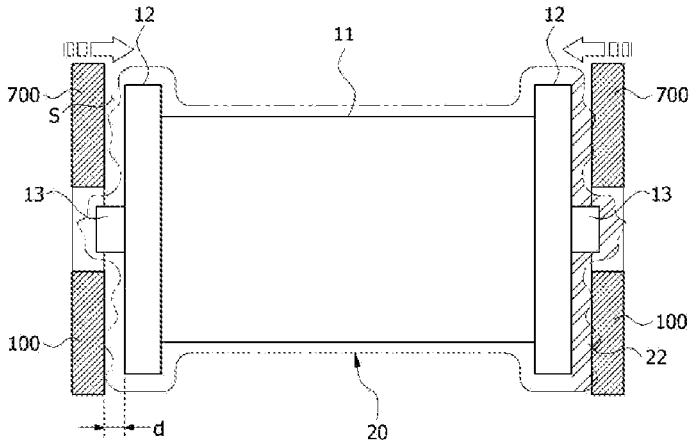

[Figure 5]
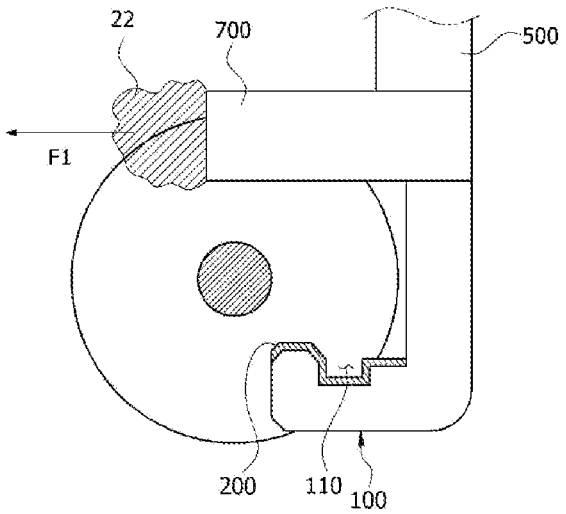
[Figure 6]
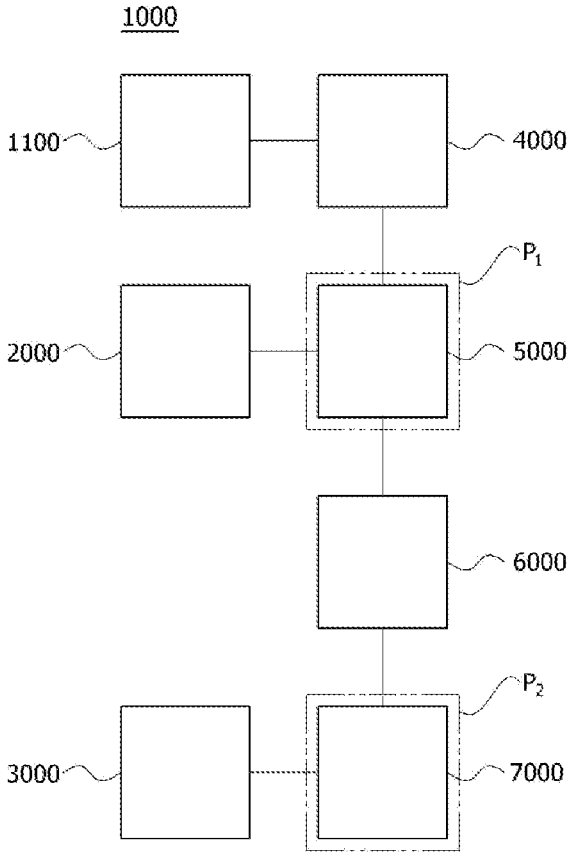

[Figure 7]
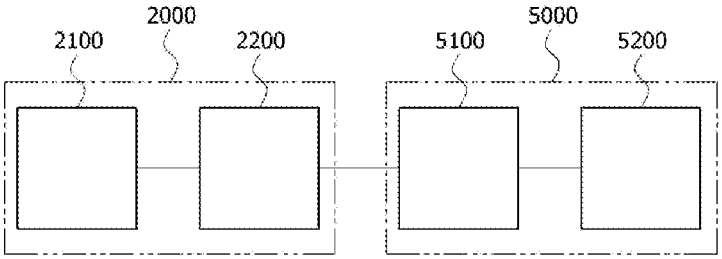
[Figure 8]
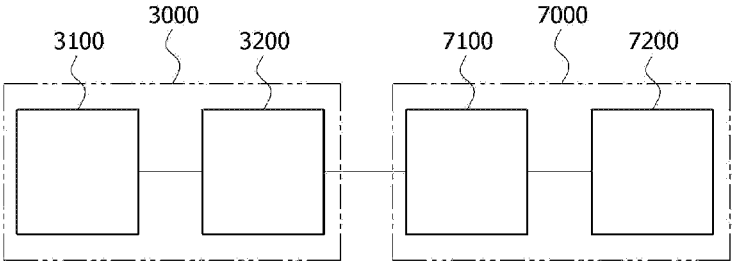

[Figure 9]
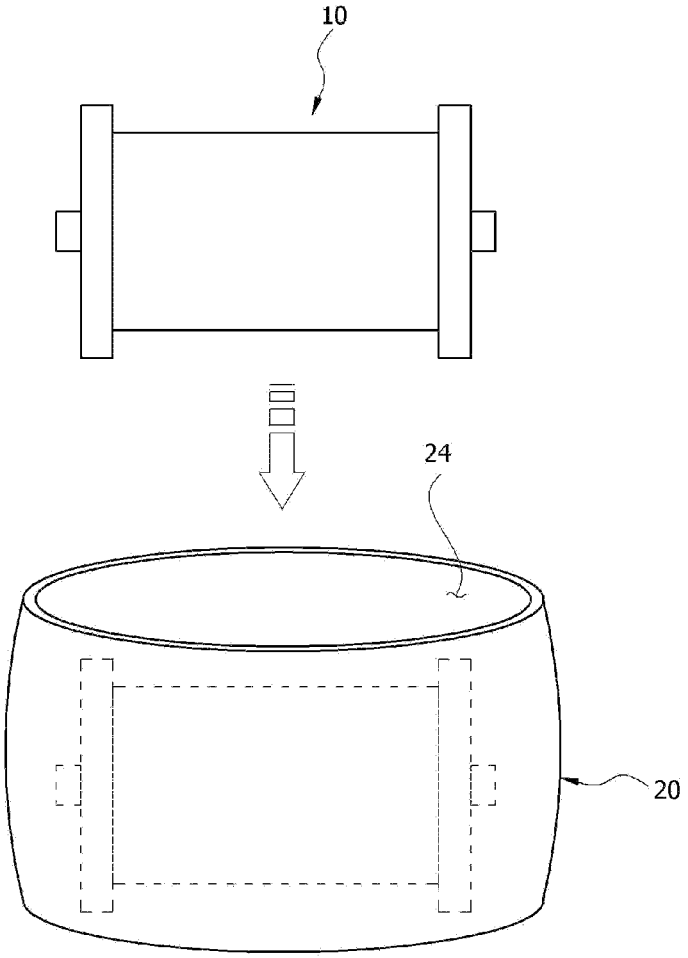

TRANSPORT DEVICE FOR ELECTRODE DOUBLE PACKAGING DEVICE, AND ELECTRODE DOUBLE PACKAGING DEVICE COMPRISING SAME

CROSS-REFERENCE TO RELATED APPLICATIONS

The present application is a National Phase entry pursuant to 35 U.S.C. § 371 of International Application No. PCT/KR2022/015514, filed on Oct. 13, 2022, and claims the benefit of and priority to Korean Patent Application No. 10-2021-0136368, filed on Oct. 14, 2021 and Korean Patent Application No. 10-2021-0140177, filed on Oct. 20, 2021, with the Korean Intellectual Property Office, the disclosures of which are incorporated herein by reference in their entirety for all purposes as if fully set forth herein.

TECHNICAL FIELD

The present disclosure relates to a transport device for a double electrode packaging device and an electrode double packaging device comprising the same.

BACKGROUND

In general, the electrode is produced, and then packaged, in a state of being wound on an electrode roll, in a packaging bag, and shipped out as a final product.

Here, in order to increase storage stability, such as prevention of moisture penetration as well as foreign substance penetration, or appearance damage, the double packaging technology performing primary packaging and secondary packaging with packaging bags of different materials was applied to the packaging of the electrode roll.

Meanwhile, in the process of transporting the electrode roll that the primary packaging had been completed to a secondary packaging location, there was a problem that a part of the packaging bag was jammed or caught in the transport device or peripheral devices, and thus the packaging bag was torn or the device was broken.

In general, the transport device of the electrode double packaging device serves to transport the electrode roll to the packaging location in a seated state. In the case of the primarily packaged electrode roll, the packaging bag was in contact with the seating portion of the transport device, and a phenomenon frequently occurred, in which the packaging bag in contact with the seating portion was torn in the contact process or in the transport process, and in order to solve this problem, a rubber pad was introduced into the seating portion.

The rubber pad needs to be replaced because it is worn out after using it for a certain period of time. However, even if the rubber pad is worn, it is not easy to immediately detect and replace it, and in fact, since the replacement time of the rubber pad was grasped from product damage caused by the wear of the rubber pad, there was a problem that product productivity was lowered.

The background description provided herein is for the purpose of generally presenting context of the disclosure. Unless otherwise indicated herein, the materials described in this section are not prior art to the claims in this application and are not admitted to be prior art, or suggestions of the prior art, by inclusion in this section.

SUMMARY

Technical Problem

It is a problem to be solved of the present disclosure to provide a transport device for an electrode double packaging device capable of preventing, in a process of transporting an electrode roll that the primary packaging has been completed to a secondary packaging location, a problem that a part of a packaging bag is jammed or caught in the transport device or peripheral devices, and an electrode double packaging device comprising the same.

In addition, it is a problem to be solved of the present disclosure to provide a packaging device for an electrode capable of preventing packaging bag damage due to a worn rubber pad by sensing abrasion of a rubber pad of a transport device provided on a seating portion of the primarily packaged electrode roll, and notifying the replacement time of the rubber pad.

Technical Solution

In order to solve the above problems, according to one aspect of the present disclosure, a transport device for an electrode double packaging device, in which an unpackaged electrode roll is primarily packaged in a first packaging bag, and the primarily packaged electrode roll is secondarily packaged in a second packaging bag is provided. The transport device comprises: a seating part having a seating groove for seating the primarily packaged electrode roll, a moving part connected to the seating part for moving the seating part, a packaging bag arrangement part provided to move together with the seating part by the moving part, and for closely attaching the first packaging bag toward the electrode roll seated on the seating groove when moving, and a control part configured to perform a seating mode for controlling the moving part to move the seating part so that the electrode roll is seated in the seating groove, and a transport mode for transporting the seating part, on which the electrode roll is seated, to a secondary packaging location.

The electrode roll may comprise a body on which the electrode is wound, a pair of support plates formed on both sides of the body, and protruding portions formed to protrude from the center of each support plate in a direction opposite to the body.

Also, the seating groove may be provided such that the protruding portions of the electrode roll are seated.

Furthermore, in the seating mode, the packaging bag arrangement part may be provided to closely attach an edge portion of the first packaging bag positioned around the support plate of the electrode roll toward a side of the support plate.

In addition, the seating mode may comprise a first movement mode in which the seating part is moved in a first direction so that the seating groove is located at the lower ends of the protruding portions of the electrode roll, and a second movement mode in which the seating part is moved in a second direction which is perpendicular to the first direction so that the lower ends of the protruding portions of the electrode roll are seated on the seating groove.

Also, upon the first movement mode, the packaging bag arrangement part may be provided to push the first packaging bag portion of the top of the protruding portion to the edge of the support plate while moving along the first direction from the top side of the protruding portion.

Furthermore, upon the first movement mode, the packaging bag arrangement part may be provided to move at a predetermined distance apart from the support plate.

In addition, upon the first movement mode, the edge portion of the first packaging bag positioned around the support plate may be accommodated in a space formed by a gap between the packaging bag arrangement part and the support plate. That is, upon the first movement mode, the first packaging bag portion pushed to the support plate side by the packaging bag arrangement part may be accommodated in the space formed by the gap between the packaging bag arrangement part and the support plate.

Also, the transport device for an electrode double packaging device may further comprise a seating pad provided in the seating groove, an abrasion sensing sensor for sensing abrasion of the seating pad, and a notification part for notifying pad replacement when the abrasion of the seating pad is sensed by the abrasion sensing sensor.

Furthermore, the control part may control the operation of the moving part when abrasion of the seating pad is sensed by the abrasion sensing sensor.

In addition, the seating pad may be a rubber pad.

Also, the abrasion sensing sensor may comprise a laser sensor.

Furthermore, when abrasion of the rubber pad is sensed by the laser sensor, the control part may be provided to stop performing the seating mode and the transport mode of the moving part.

According to another aspect of the present disclosure, an electrode double packaging device comprising an electrode roll supply part for supplying an unpackaged electrode roll, a first packaging bag supply part for supplying a first packaging bag to a primary packaging location, a second packaging bag supply part for supplying a second packaging bag of a material different from that of the first packaging bag to a secondary packaging location, a first transport device for transporting the unpackaged electrode roll, a first packaging part for primarily packaging the unpackaged electrode roll transported by the first transport device with the first packaging bag, a second transport device for transporting the primarily packaged electrode roll, and a second packaging part for secondarily packaging the primarily packaged electrode roll transported by the second transport device with the second packaging bag is provided.

Here, the second transport device comprises: a seating part having a seating groove on which the primarily packaged electrode roll is seated, a moving part connected to the seating part for moving the seating part, a packaging bag arrangement part provided to move together with the seating part by the moving part, and for closely attaching the first packaging bag to the electrode roll side when moving, and a control part configured to perform a seating mode for controlling the moving part to move the seating part so that the electrode roll is seated in the seating groove, and a transport mode for transporting the seating part, on which the electrode roll is seated, to the secondary packaging location.

Also, the electrode roll may comprise a body on which the electrode is wound, a pair of support plates formed on both sides of the body, and protruding portions formed to protrude from the center of each support plate in a direction opposite to the body, the seating groove may be provided to seat the protruding portions of the electrode roll, and in the seating mode, the packaging bag arrangement part may be provided to closely attach an edge portion of the first packaging bag positioned around the support plate of the electrode roll toward a side of the support plate.

Furthermore, the seating mode may comprise a first movement mode in which the seating part is moved in a first direction so that the seating groove is located at the lower ends of the protruding portions of the electrode roll, and a second movement mode in which the seating part is moved in a second direction which is perpendicular to the first direction so that the lower ends of the protruding portions of the electrode roll are seated on the seating groove.

In addition, the second transport device may comprise a seating pad provided in the seating groove, an abrasion sensing sensor for sensing abrasion of the seating pad, and a notification part for notifying pad replacement when the abrasion of the seating pad is sensed by the abrasion sensing sensor.

Also, the first packaging bag may be a polyethylene packaging bag, and the second packaging bag may be an aluminum packaging bag.

Furthermore, the seating pad may be a rubber pad, and the abrasion sensing sensor may comprise a laser sensor.

In addition, when abrasion of the rubber pad by the laser sensor is sensed, the control part may be provided to stop performing the seating mode and the transport mode of the moving part.

Advantageous Effects

As described above, the transport device for an electrode double packaging device related to at least one example of the present disclosure, and an electrode double packaging device comprising the same have the following effects.

Before the electrode roll primarily packaged with the first packaging bag is moved to the secondary packaging location, the first packaging bag is arranged such that it is closely attached to the electrode roll, whereby the jamming/trapping of the first packaging bag that can occur in the process of being transported to the second packing location is prevented, so that it is possible to solve the problem that the packaging bag is torn or the peripheral devices are broken.

In addition, by sensing the abrasion of the rubber pad through the abrasion sensing sensor and notifying the replacement signal of the pad, it is possible to prevent damage to the packaging bag due to the abrasion of the rubber pad.

BRIEF DESCRIPTION OF DRAWINGS

FIG. 1 is a diagram showing an exemplary transport device for an electrode double packaging device according to the present disclosure.

FIG. 2 is a diagram for explaining the structure of the primarily packaged electrode roll.

FIGS. 3 to 5 are diagrams for explaining the operating principle of the transport device.

FIGS. 6 to 8 are configuration diagrams showing exemplary electrode double packaging devices according to the present disclosure.

FIG. 9 is a diagram for explaining a process in which an electrode roll is transported into a packaging bag.

DETAILED DESCRIPTION

In the entire specification, when a part "comprises" a certain component, it means that other components may be further included, rather than excluding other components, unless otherwise stated. Also, in the entire specification, when a part is "connected" or "coupled" to another part, it comprises not only a case of being "directly connected" or "directly coupled", but also a case of being connected "with another configuration interposed in the middle".

Hereinafter, examples of the present disclosure will be described in detail with reference to the accompanying drawings so that those having ordinary knowledge in the technical field to which the present disclosure pertains can easily carry out them. However, the present disclosure may be embodied in various different forms, which is not limited to the examples described herein. Then, in order to clearly explain the present disclosure in the drawings, parts irrelevant to the description have been omitted, and similar reference numerals are attached to similar parts throughout the specification.

Hereinafter, the present disclosure will be described in detail with reference to the accompanying drawings.

FIG. 1 is a diagram showing an exemplary transport device (1) for an electrode double packaging device according to the present disclosure, FIG. 2 is a diagram for explaining the structure of the primarily packaged electrode roll, and FIGS. 3 to 5 are diagrams for explaining the operating principle of the transport device.

The present disclosure relates to a transport device (1) of an electrode double packaging device for primarily packaging an unpackaged electrode roll with a first packaging bag and secondarily packaging the primarily packaged electrode roll with a second packaging bag. For example, the transport device (1) may be a device for transporting the electrode roll, on which the primary packaging is completed, to a secondary packaging location.

Referring to FIGS. 1 to 3, the transport device (1) comprises a seating part (100), a packaging bag arrangement part (700), a moving part (500), and a control part (600).

The seating part (100) has a seating groove (110) for seating the primarily packaged electrode roll.

In addition, the moving part (500) is provided to move the seating part (100), and the moving part (500) may be composed of a known driving part such as an oil hydraulic cylinder, a pneumatic cylinder, or a motor.

The control part (600) is provided to perform a seating mode for controlling the moving part (500) to move the seating part (100) so that the electrode roll is seated in the seating groove (110), and a transport mode for transporting the seating part (100), on which the electrode roll is seated, to the secondary packaging location.

The packaging bag arrangement part (700) is provided to move together with the seating part (100) by the moving part (500), and is provided to closely attach the first packaging bag (20) toward the electrode roll seated on the seating groove (110) when moving. That is, the packaging bag arrangement part (700) performs a function of arranging the first packaging bag (20) so that the first packaging bag (20) is closely attached toward the electrode roll seated on the seating groove (110) when moving. The packaging bag arrangement part (700) is connected to the seating part (100), which may have, in one example, a plate shape.

The control part (600) may be provided to perform a seating mode for controlling the moving part (500), whereby the electrode roll moves to be seated in the seating groove (110), and a transport mode for transporting the seating part (100), on which the electrode roll is seated, to the secondary packaging location. The control part (600) may control the moving part (500) to sequentially perform a seating mode and a transport mode. In addition, the moving part (500), the seating part (100), and the packaging bag arrangement part (700) may be connected to each other. Accordingly, the seating part (100) and the packaging bag arrangement part (700) may move together in the moving direction of the moving part (500). In addition, the control part (600) may control the moving part (500) to perform a separation mode in which the electrode roll is separated from the seating part (100). The separation mode may be performed after arriving at the secondary packaging location.

Referring to FIG. 2, the electrode roll may comprise a body (11) on which the electrode is wound, a pair of support plates (12) formed on both sides of the body (11), and protruding portions (13) formed to protrude from the center of each support plate in a direction opposite to the body (11). The body (11) may have, for example, a cylindrical shape, and the support plate (12) may be formed to have a larger diameter than the diameter of the body (11). The support plate (12) functions to prevent the electrode wound on the body (11) from being separated to the outside.

Also, the seating groove (110) is provided so that the protruding portion (13) of the electrode roll is seated, and as the protruding portion (13) is seated in the seating groove (110), it is possible to prevent the protruding portion (13) from being separated to the outside of the seating part (100) in the transport process.

Furthermore, the primarily packaged electrode roll is completely surrounded by the first packaging bag (20), and the edge portion (22) of the first packaging bag (20) is positioned around the support plate (12). The edge portion (22) of the first packaging bag (20) refers to a portion protruding to the outside without being in close contact with the electrode roll (10). In the present application, the packaging bag arrangement part (700) serves to arrange the edge portion (22) of the first packaging bag.

In addition, in the seating mode, the packaging bag arrangement part (700) is provided to closely attach the edge portion (22) of the first packaging bag (20) positioned around the support plate (12) of the electrode roll to the support plate (12) side. The edge portion (22) of the first packaging bag (20) means a portion swollen to protrude the outside of the support plate (12) without being closely attached to the support plate (12) side.

The edge portion (22) of the first packaging bag (20) may cause a problem of being caught or jammed in a peripheral device or a transport device during the transport mode. The packaging bag arrangement part (700) may prevent the jamming problem in advance by arranging the edge portion (22) of the first packaging bag (20) in the seating mode, which is a step before the transport mode.

Also, the seating mode may comprise a first movement mode in which the seating part (100) is moved in a first direction (F1) so that the seating groove (110) is located at the lower ends of the protruding portions (13) of the electrode roll, and a second movement mode in which the seating part (100) is moved in a second direction (F2) which is a perpendicular direction to the first direction (F1) so that the lower ends of the protruding portions (13) of the electrode roll are seated on the seating groove (110).

Furthermore, upon the first movement mode, the packaging bag arrangement part (700) may be provided to push the edge portion of the first packaging bag located on the top of the protruding portion (13) toward the support plate (12) while moving along the first direction (F1) from the top side of the protruding portion (13).

Referring to FIGS. 3 and 4, upon the first movement mode, the packaging bag arrangement part (700) may be moved along the first direction (F1) from the top side of the protruding portion (13). The packaging bag arrangement part (700) may be arranged vertically to face the seating part (100) with the protruding portion (13) interposed therebetween. The packaging bag arrangement part (700) may closely attach the edge portion of the first packaging bag (20) located around the support plate (12) of the electrode roll along the first direction (F1) from the top side of the protruding portion (13) to the support plate (12) side.

In addition, upon the first movement mode, the packaging bag arrangement part (700) may be provided to move at a predetermined distance (d) apart from the support plate (12).

Upon the first movement mode, the edge portion (22) of the first packaging bag positioned around the support plate (12) may be accommodated in the space (S) formed by the gap (d) between the packaging bag arrangement part (700) and the support plate (12). That is, upon the first movement mode, the first packaging bag portion pushed to the support plate (12) side by the packaging bag arrangement part (700) may be accommodated in the space (S) formed by the gap (d) between the packaging bag arrangement part (700) and the support plate (12).

When performing the seating mode, the control part (600) may control the second movement mode to be performed after the first movement mode is performed. In the first movement mode, the seating part (100) and the protruding portion (13) do not contact each other, and in the second movement mode, the protruding portion (13) is seated on the seating groove (110).

In addition, the transport device (1) for an electrode double packaging device may comprise a seating pad (200) provided in the seating groove (110), an abrasion sensing sensor (300) for sensing abrasion of the seating pad (200), and a notification part (400) for notifying pad replacement when the abrasion of the seating pad (200) is sensed by the abrasion sensing sensor.

The seating pad (200) is provided in the seating groove (110) in which the protruding portion (13) of the primarily packaged electrode roll is seated. Accordingly, the seating pad (200) has a seating surface on which the protruding portion (13) of the electrode roll is seated. The abrasion sensing sensor (300) senses the abrasion of the seating pad (200). The notification part (400) notifies the replacement of the pad when the abrasion of the seating pad (200) is sensed by the abrasion sensing sensor (300).

In addition, the control part (600) may control the operation of the moving part (500) according to whether the abrasion of the seating pad (200) is sensed by the abrasion sensing sensor (300).

The seating pad (200) may be formed of a material different from that of the seating groove (110). For example, the seating pad (200) may be a rubber pad formed of a rubber material.

The transport device (1) according to the present application notifies the replacement time of the rubber pad (200) through the abrasion sensing sensor (300) and the notification part (400), whereby the problem that the packaging bag is torn by the worn rubber pad (200) problems can be prevented. The abrasion sensing sensor (300) may be, for example, a laser sensor.

The abrasion sensing sensor (300) is provided to recognize the seating surface of the rubber pad (200) that is not worn. When the rubber pad (200) is worn, the abrasion sensing sensor (300) generates an error because the seating surface is unrecognized. In addition, the abrasion sensing sensor (300) is provided to recognize at least some areas of the rubber pad (200). The abrasion sensing sensor (300) is provided to recognize at least some areas of the rubber pad (200), whereby in the process of replacing the worn rubber pad (200) with a new rubber pad, if the new rubber pad is not mounted by mistake (pad missing), at least some areas of the rubber pad (200) are not recognized, thereby generating an error.

When such an error occurs, the notification part (400) may notify the replacement time of the worn pad in visual and audible methods.

Also, the abrasion sensing sensor (300) may comprise a laser sensor.

Furthermore, when the abrasion of the rubber pad (200) is sensed by the laser sensor, the control part (600) may be provided to stop performing the seating mode and the transport mode of the moving part (500).

As the operation of the moving part (500) is controlled by the control part (600), the operator can safely perform the replacement work of the worn pad.

For example, when the abrasion of the rubber pad (200) is sensed by the abrasion sensing sensor (300), the control part (600) may stop performing the seating mode and the transport mode of the moving part (500). Furthermore, as the seating mode and the transport mode of the moving part (500) are stopped, the entire process of the packaging device may be stopped. This is to prevent a product with the torn packaging bag by the worn rubber pad from being shipped out as a final product.

FIGS. 6 to 8 are configuration diagrams showing exemplary electrode double packaging devices (1000) according to the present disclosure, and FIG. 9 is a diagram for explaining a process in which an electrode roll is transported into a packaging bag.

The present application relates to an electrode double packaging device (100) comprising the transport device (1) for the electrode double packaging device described through FIGS. 1 to 5.

Referring to FIG. 6, the electrode double packaging device (1000) related to one example of the present disclosure comprises an electrode roll supply part (1100), a first packaging bag supply part (2000), a second packaging bag supply part (3000), a first transport device (4000), a first packaging part (5000), a second transport device (6000), and a second packaging part (7000).

The electrode double packaging device (1000) comprises an electrode roll supply part (1100) for supplying an unpackaged electrode roll, a first packaging bag supply part (2000) for supplying a first packaging bag to a primary packaging location (P1), and a second packaging bag supply part (3000) for supplying a second packaging bag of a material different from that of the packaging bag to a secondary packaging location (P2), a first transport device (4000) for transporting the unpackaged electrode roll, and a first packaging part (5000) for primarily packaging the unpackaged electrode roll transported by the first transport device (4000) with the first packaging bag, a second transport device (6000) for transporting the primarily packaged electrode roll, and a second packaging part (7000) for secondarily packaging the primarily packaged electrode roll transported by the second transport device (6000) with the second packaging bag.

The electrode roll supply part (1100) supplies an unpackaged electrode roll. Here, the unpackaged electrode roll means an electrode roll that is not packaged with the first packaging bag and the second packaging bag.

Referring to FIGS. 6 and 7, the first packaging bag supply part (2000) supplies the first packaging bag to the primary packaging location ($P_1$). The first packaging bag supply part (2000) may comprise a first packaging seating part (2100) in which a plurality of first packaging bags is seated, and a first packaging bag transport part (2200) for transporting the first packaging bags from the first packaging bag seating part (2100) to the first packaging location (P1) one by one.

Referring to FIGS. 6 and 8, the second packaging bag supply part (3000) supplies a second packaging bag of a material different from that of the first packaging bag to the secondary packaging location (P2). The second packaging bag supply part (3000) may comprise a second packaging bag seating part (3100) in which a plurality of second packaging bags is seated, and a second packaging bag transport part (3200) for transporting the second packaging bags from the second packaging bag seating part (3100) to the secondary packaging location (P2) one by one.

The first transport device (4000) may comprise a first seating part provided to allow the unpackaged electrode roll to be seated, and a first moving part for moving the first seating part. In addition, the first transport device (4000) may comprise a first control part for performing a first seating mode that controls the first moving part, whereby the unpacked electrode roll moves to be seated, and a first transport mode that transports the seated unpackaged electrode roll to the primary packaging location. The first transport device (4000) may be provided to perform the first transport mode after completing the first seating mode.

The first packaging part (5000) primarily packages the unpackaged electrode roll transported by the first transport device (4000) with the first packaging bag. The first packaging part (5000) is located at the primary packaging location ($P_1$).

The second transport device (6000) is the same as the transport device (1) for the electrode double packaging device described through FIGS. 1 to 5. Specifically, the second transport device (6000) comprises a seating part (100, see FIG. 1) having a seating groove provided so that the primarily packaged electrode roll can be seated, a moving part (500, see FIG. 1) for moving the seating part, a packaging bag arrangement part (700, see FIG. 1) provided to move together with the seating part by the moving part, and for arranging the first packaging bag so that the first packaging bag is closely attached toward the electrode roll seated in the seating groove when moving, and a control part (600, see FIG. 1) provided to perform a seating mode that controls the moving part, whereby the electrode roll moves to be seated in the seating groove, and a transport mode that transports the electrode roll seated in the seating part to a secondary packaging location. In order to distinguish them from the components of the first transport device, in this document, the seating part of the second transport device (6000) may be referred to as a second seating part, and the moving part may be referred to as a second moving part, and the control part may be referred to as a second control part.

As described above through FIGS. 1 to 5, the seating mode may comprise a first movement mode in which the seating part is moved in a first direction so that the seating groove is located at the lower ends of the protruding portions of the electrode roll, and a second movement mode in which the seating part is moved in a second direction which is a perpendicular direction to the first direction so that the lower ends of the protruding portions of the electrode roll are seated on the seating groove.

In addition, the second transport device (6000) may further comprise a seating pad provided in the seating groove, an abrasion sensing sensor for sensing abrasion of the seating pad, and a notification part for notifying pad replacement when the abrasion of the seating pad is sensed by the abrasion sensing sensor.

Since the second transport device (6000) is the same device as the above-described transport device (1), detailed descriptions of the structure and operation of the second transport device (6000) will be omitted because they overlap with the above-described contents.

The second packaging part (7000) secondarily packages the electrode roll transported by the second transport device (6000) with the second packaging bag.

Referring to FIGS. 7 and 9, the first packaging bag (20) may comprise a first opening portion (22), and the first packaging part (5000) may comprise a packaging bag expansion portion (5100) to expand the first opening portion (24), and a first packaging bag sealing portion (5200) to seal the first opening portion (24).

In addition, the second packaging bag may also comprise a second opening portion in the same manner as the first packaging bag. At this time, the second packaging part (7000) may comprise a second packaging bag expansion portion (7100) to expand the second opening portion and a second packaging bag sealing portion (7200) to seal the second opening portion. The first and second packaging bag expansion portions serve to expand the opening portions in order to secure a space where the electrode roll can enter the inside of the packaging bag.

Furthermore, the first packaging bag sealing portion (5200) may perform vacuum sealing. In addition, the second packaging bag sealing portion (7200) may also perform vacuum sealing. By performing the vacuum sealing, the storage retainability of the electrode can be improved.

In one example, the first packaging bag may be a polyethylene packaging bag. The polyethylene packaging bag function to prevent foreign substance penetration.

In another example, the second packaging bag may be an aluminum packaging bag. The aluminum packaging bag functions to prevent moisture penetration.

Besides, the material of the packaging bag may be selected from various materials according to a desired purpose.

The preferred examples of the present disclosure as described above are disclosed for the purpose of illustration, and skilled person having ordinary knowledge of the present disclosure will be able to make various modifications, changes, and additions within the spirit and scope of the present disclosure, and such modifications, changes, and additions shall be deemed to fall within the scope of the following claims.

INDUSTRIAL APPLICABILITY

According to the transport device for the electrode double packaging device related to at least one example of the present disclosure, and the electrode double packaging device comprising the same, it is possible to prevent the packaging bag from being jammed in the transport process.

The invention claimed is:

1. A transport device for an electrode double packaging device in which an unpackaged electrode roll is primarily packaged in a first packaging bag, and the primarily packaged electrode roll is secondarily packaged in a second packaging bag, the transport device comprising:

a seating part having a seating groove for seating the primarily packaged electrode roll;

a moving part connected to the seating part for moving the seating part;

a packaging bag arrangement part provided to be moved together with the seating part by the moving part, and for closely attaching the first packaging bag to the electrode roll seated on the seating groove when moving; and a control part configured to perform a seating mode for controlling the moving part to move the seating part so that the electrode roll is seated in the seating groove, and a transport mode for transporting the seating part, on which the electrode roll is seated, to a secondary packaging location.

2. The transport device for an electrode double packaging device according to claim 1, wherein:

the electrode roll comprises a body on which an electrode is wound, a pair of support plates formed on opposite sides of the body, and protruding portions formed to protrude from a center of each support plate in a direction opposite to the body, and the seating groove is provided such that the protruding portions of the electrode roll are seated thereon.

3. The transport device for an electrode double packaging device according to claim 2, wherein:

in the seating mode, the packaging bag arrangement part closely attaches an edge portion of the first packaging bag positioned around one of the support plates of the electrode roll to a side of the one of the support plates.

4. The transport device for an electrode double packaging device according to claim 3, wherein the seating mode comprises:

a first movement mode in which the seating part is moved in a first direction so that the seating groove is located at lower ends of the protruding portions of the electrode roll; and a second movement mode in which the seating part is moved in a second direction which is perpendicular to the first direction so that the lower ends of the protruding portions of the electrode roll are seated on the seating groove.

5. The transport device for an electrode double packaging device according to claim 4, wherein in the first movement mode, the packaging bag arrangement part pushes portions of the first packaging bag above the protruding portions toward the support plates while moving along the first direction above the protruding portions.

6. The transport device for an electrode double packaging device according to claim 5, wherein in the first movement mode, the packaging bag arrangement part moves at a predetermined distance apart from the support plates.

7. The transport device for an electrode double packaging device according to claim 6, wherein:

in the first movement mode, the edge portion of the first packaging bag positioned around the one of the support plates is accommodated in a space formed by a gap between the packaging bag arrangement part and the one of the support plates.

8. The transport device for an electrode double packaging device according to claim 1, further comprising:

a seating pad provided in the seating groove;

an abrasion sensing sensor for sensing abrasion of the seating pad; and a notification part for notifying a need for pad replacement when abrasion of the seating pad is sensed by the abrasion sensing sensor.

9. The transport device for an electrode double packaging device according to claim 8, wherein the control part controls operation of the moving part when abrasion of the seating pad is sensed by the abrasion sensing sensor.

10. The transport device for an electrode double packaging device according to claim 9, wherein:

the seating pad is a rubber pad, the abrasion sensing sensor comprises a laser sensor, and when abrasion of the rubber pad is sensed by the laser sensor, the control part stops performing the seating mode and the transport mode of the moving part.

11. An electrode double packaging device comprising:

an electrode roll supply part for supplying an unpackaged electrode roll;

a first packaging bag supply part for supplying a first packaging bag to a primary packaging location;

a second packaging bag supply part for supplying a second packaging bag of a material different from that of the first packaging bag to a secondary packaging location;

a first transport device for transporting the unpackaged electrode roll;

a first packaging part for primarily packaging the unpackaged electrode roll transported by the first transport device with the first packaging bag;

a second transport device for transporting the primarily packaged electrode roll; and a second packaging part for secondarily packaging the primarily packaged electrode roll transported by the second transport device with the second packaging bag, wherein the second transport device comprises:

a seating part having a seating groove on which the primarily packaged electrode roll is seated;

a moving part connected to the seating part for moving the seating part;

a packaging bag arrangement part provided to be moved together with the seating part by the moving part, and for closely attaching the first packaging bag to a side of the electrode roll when moving; and a control part configured to perform a seating mode for controlling the moving part to move the seating part so that the electrode roll is seated in the seating groove, and a transport mode for transporting the seating part, on which the electrode roll is seated, to the secondary packaging location.

12. The electrode double packaging device according to claim 11, wherein:

the electrode roll comprises a body on which an electrode is wound, a pair of support plates formed on opposite sides of the body, and protruding portions formed to protrude from a center of each support plate in a direction opposite to the body, the seating groove is provided such that the protruding portions of the electrode roll are seated thereon, and in the seating mode, the packaging bag arrangement part closely attaches an edge portion of the first packaging bag positioned around one of the support plates of the electrode roll to a side of the one of the support plates.

13. The electrode double packaging device according to claim 12, wherein the seating mode comprises:

a first movement mode in which the seating part is moved in a first direction so that the seating groove is located at lower ends of the protruding portions of the electrode roll; and a second movement mode in which the seating part is moved in a second direction which is perpendicular to the first direction so that the lower ends of the protruding portions of the electrode roll are seated on the seating groove.

14. The electrode double packaging device according to claim 11, wherein the second transport device further comprises:

a seating pad provided in the seating groove;

an abrasion sensing sensor for sensing abrasion of the seating pad; and a notification part for notifying a need for pad replacement when abrasion of the seating pad is sensed by the abrasion sensing sensor.

15. The electrode double packaging device according to claim 11, wherein:

the first packaging bag is a polyethylene packaging bag, and the second packaging bag is an aluminum packaging bag.

* * * * *